United States Patent [19]

Koshizuka et al.

[11] Patent Number: 4,643,917

[45] Date of Patent: Feb. 17, 1987

[54] HEAT-SENSITIVE TRANSFER RECORDING MEDIUM

[75] Inventors: Kunihiro Koshizuka; Shigehiro Kitamura; Takao Abe; Masaki Nakamura; Fumio Ishii; Yuji Hotta, all of Hino, Japan

[73] Assignee: Konishiroku Photo Industry Co., Ltd., Tokyo, Japan

[21] Appl. No.: 663,386

[22] Filed: Oct. 22, 1984

[30] Foreign Application Priority Data

| | | | |
|---|---|---|---|
| Nov. 2, 1983 | [JP] | Japan | 58-204709 |
| Nov. 4, 1983 | [JP] | Japan | 58-205887 |
| Dec. 2, 1983 | [JP] | Japan | 58-226761 |
| Dec. 26, 1983 | [JP] | Japan | 58-244265 |
| Dec. 27, 1983 | [JP] | Japan | 58-244648 |

[51] Int. Cl.[4] ..... B41M 5/26

[52] U.S. Cl. ..... 427/256; 156/234; 156/277; 427/146; 427/148; 427/288; 428/195; 428/447; 428/452; 428/484; 428/488.1; 428/913; 428/914

[58] Field of Search ..... 346/200, 204, 226; 428/195, 203, 204, 207, 484, 488.1, 488.4, 913, 914, 447, 452; 156/230, 234, 239, 240, 277; 427/146, 148, 256, 288

[56] References Cited

U.S. PATENT DOCUMENTS

| | | | |
|---|---|---|---|
| 2,866,711 | 12/1958 | Hart | 428/488.1 |
| 3,087,832 | 4/1963 | Fogle | 428/914 |
| 3,387,986 | 6/1968 | Elbert et al. | 428/484 |

FOREIGN PATENT DOCUMENTS

| | | | |
|---|---|---|---|
| 0101095 | 6/1983 | Japan | 428/914 |

*Primary Examiner*—Bruce H. Hess

*Attorney, Agent, or Firm*—Frishauf, Holtz, Goodman & Woodward

[57] ABSTRACT

There is disclosed a heat-sensitive transfer recording medium comprising a support and, provided thereon, a colorant-containing layer for heat-sensitive transfer, wherein said colorant-containing layer contains a silicone wax as a heat-fusible material which is solid or semi-solid at ambient temperature or room temperature.

The recording medium according to the present invention is capable of printing at low energy and with high transfer sensitivity.

12 Claims, No Drawings

HEAT-SENSITIVE TRANSFER RECORDING MEDIUM

BACKGROUND OF THE INVENTION

This invention relates to a heat-sensitive transfer recording medium, more particularly to a heat-sensitive transfer recording medium capable of printing letters at low energy with high transfer sensitivity and also capable of suppressing generation of ground staining (fog) on the recording sheet such as plain paper.

Heat-sensitive recording medium has heretofore been employed as the recording medium for forming an image on a recording sheet such as plain paper by transfer by means of a thermal printer or a thermal facscimile, etc. Such a heat-sensitive recording medium has at least one colorant-containing layer provided on a support, and a typical colorant-containing layer known in the art comprises a coloring agent made of a dyestuff such as a pigment, etc. and a heat-fusible material. For such a heat-fusible material, low melting materials such as waxes, etc. have been employed. On the other hand, for the support, in order to obtain good reproducibility of the dyestuff transferred image obtained from the colorant-containing layer coated thereon, films excellent in surface smoothness and dimensional stability have been employed.

For recording a dyestuff (or dye) transferred image on plain paper, etc. by use of such a heat-sensitive transfer recording medium, it is desired to print letters at low energy when utilizing a thermal printer or a thermal facscimile having a thermal head. However, the heat-sensitive transfer recording medium of the prior art had insufficiently low transfer sensitivity. Also, there was also involved the drawback of generation of ground staining (fog) on the recording sheet.

As one method for enhancing transfer sensitivity, there is disclosed the technique of improving thermal conductivity of the colorant-containing layer in Japanese Provisional Patent Publication (KOKAI) No. 75894/1981. The invention disclosed in this Patent Publication is a technique incorporating a powdery thermoconductive material in a colorant-containing layer, which requires use of an additive, and therefore the colorant-containing layer becomes thicker depending on the additive employed, whereby resolution of the image may sometimes be lowered. Also, there was involved the drawback of generation of ground staining (fog) on the recording sheet.

SUMMARY OF THE INVENTION

An object of this invention is to provide a heat-sensitive transfer recording medium capable of printing letters at low energy with high transfer sensitivity.

Another object of this invention is to provide a heat-sensitive transfer recording medium capable of suppressing generation of ground staining (fog) on a recording sheet such as plain paper and providing dyestuff transferred image of high resolution.

The present inventor has made extensive studies and consequently found that the above objects can be accomplished by incorporating at least a silicone wax which is solid or semi-solid at ambient temperature in the colorant-containing layer of a heat-sensitive transfer recording medium having a heat-sensitive transferable colorant-containing layer on a support to accomplish this invention.

Thus, the present inventor was successful in attaining the above objects of this invention by choosing a specific heat-fusible material rather than adding a thermoconductive material as attempted by the prior art in order to attain the above objects.

DETAILED DESCRIPTION OF PREFERRED EMBODIMENTS

The heat-sensitive transfer recording medium of the present invention has at least one colorant-containing layer on a support. The colorant-containing layer contains at least one silicone wax of this invention. The silicone wax of this invention is solid or semi-solid at ambient temperature (25° C.), preferably solid (accordingly, silicone oils which are liquid at ambient temperature are excluded), having a melting point of 30° C. or higher (as measured by the Yanagimoto Model MPJ-2), preferably 35° C. or higher, particularly preferably 40° C. or higher. The silicone wax of this invention refers to compounds having —SiO—bonding as the main chain or the side chain, or wax having Si—O bonding. Also, the silicone wax of this invention may be the above silicone wax having reactive groups (e.g. —OH, $—NH_2$, groups containing unsaturated bonding, epoxy deriving group) introduced at the terminal ends of the molecular chains thereof, and the copolymers formed after the reactions of such compounds with other compounds. Preferably, the silicone wax of this invention should comprise 10% or more of silicon and oxygen based on the total weight.

Preferable examples of the silicone wax of this invention are represented by the following formula (I):

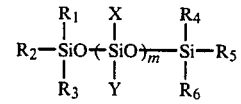

(I)

wherein $R_1$ to $R_6$ each represents a hydrogen atom, or an organic group such as an alkyl group, an aryl group, an alkoxy group, etc., typically a methyl group or a methoxy group, or alternatively a side chain group of high molecular weight such as a polymeric chain; X and Y each represent a hydrogen atom, an organic group such as an alkyl group, an aryl group, an aralkyl group or an alkoxy group, a group $CH_2O)_a(C_2H_4O)_b(C_3H_6O)_cR_7$ ($R_7$ represents an alkyl group, and a, b and c are positive integers) or a group $—O—CO—C_nH_{2n}R_8$ ($R_8$ represents a substituent such as a straight-chain or branched alkyl group, an aralkyl group or an aryl group, and n represents a positive integer), particularly one having not more than about 40 carbon atoms, and these organic groups may optionally been substituted by an alcoholic OH group, an amino group, a SH group, an amide group, an ester group or the like; and m represents a positive integer.

These substituents are not particularly limited, but in view of compatibility with other wax components and the polymer, X (X1, X2, . . . and Xp) and Y (Y1, Y2 . . . and Yp) should preferably be substituted with substituents of higher molecular weight at a percentage of 10% or higher rather than being all hydrogen atoms or methyl groups.

Further, the silicon wax of this invention is particularly preferably one represented by the following formula (II):

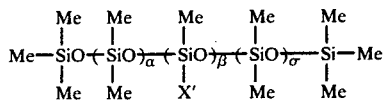

wherein Me represents a methyl group, X' is the same as X as defined above, preferably, for example, $-C_nH_{2n}R_8$($R_8$ *represents a hydrogen atom or a substituent such as a straight or branched alkyl group or aralkyl group*), $-O-C_nH_{2n}R_8$ ($R_8$ is the same as defined above), $-O-CO-C_nH_{2n}R_8$ ($R_8$ is the same as defined above), $-C_nH_{2n}Y$ (Y represents a group such as —OH, —SH, etc.), $-C_nH_{2n}COOR_9$ ($R_9$ represents an alkyl group or other organic group having 1 to 40 carbon atoms) or $(CH_2O)_a(C_2H_4O)_b(C_3H_6O)_cR_7$ ($R_7$ represents an alkyl group, and a, b and c are positive integers), each n being positive integer; and $\alpha$, $\beta$ and $\sigma$ are each integer of 0 or more, with proviso that all of $\alpha$, $\beta$ and $\sigma$ cannot be zero at the same time.

For example, if $\sigma$ is zero, the melting point is higher as the values of $\alpha$ and $\beta$ are greater, and as the value of $\alpha$ is greater as compared with $\beta$. Further the melting point becomes higher as the molecular weight of the substituent X is higher. Thus, depending on the molecular weight of the substituent X, it is possible to select the values for $\alpha$ and $\beta$, and both of $\alpha$ and $\beta$ should preferably be 0 to 1000, more preferably not more than 500, particularly preferably not more than 100.

Typical examples of the compounds represented by the above formulae (I) and (II) are illustrative of a part of the silicone waxes of this invention and they are not limitative of this invention.

For example, the silicone wax of this invention may have a multi-dimensional, i.e. two-or three-dimensional, bonding structure (varnish structure) as shown below:

(III)

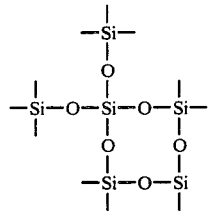

Of course, even in the case of having a multi-dimensional bonding structure (varnish structure), the structure may be substituted with an organic group. Typical examples having such a varnish structure may include KR216, KR220 and X-22-801 produced by Shinetsu Kagaku K. K., Japan. Specific examples of the silicone waxes of this invention are enumerated below:

(1)

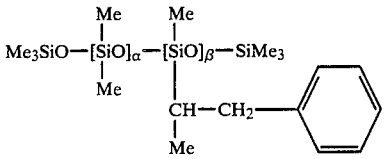

(2)

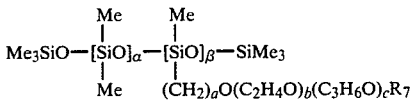

-continued (3)

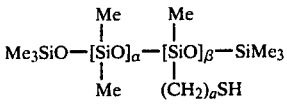

(4)

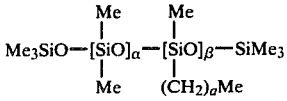

(5)

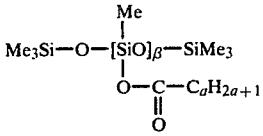

(6)

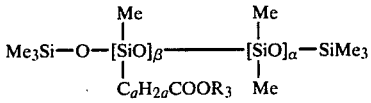

(7)

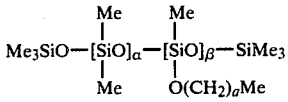

In the above formulae, $\alpha$, $\beta$, are integers of 0 or more, and a, b and c are positive integers of, and $\alpha$ and $\beta$ cannot be 0 at the same time; $R_7$ is an alkyl group, $R_9$ is an alklyl group or other organic group having 1 to 40 carbon atoms; and Me represents a methyl group.

The silicone wax of this invention includes, in addition to those as mentioned above, typically fluorine-modified silicone wax having trifluoroalkyl groups in the molecule, hydrophilic silicone wax having particularly hydrophilic groups introduced into the molecule, silicone wax modified with higher fatty acid, carnauba-modified silicone wax, carboxyl-modified silicone wax, amide-modified silicone wax, etc., but this invention is not limited to these. Further, the compounds available may be those in which reactive groups (e.g. —OH, $-NH_2$, groups containing unsaturated bonding, epoxy deriving group) are introduced at the substituent moiety or at the terminals of $R_1$ to $R_6$, and those formed after reaction of those compounds with other compounds.

The silicone wax of this invention may be used either as a single substance or a combination of two or more compounds. Alternatively, it can also be used as a mixture with another heat-fusible substance. Preferably the silicone wax of this invention comprises 10 to 100% (wt. %, hereinafter the same) of the heat-fusible material contained in the colorant-containing layer, more preferably 30% or more, particularly preferably 50% or more.

The heat-fusible material which can be used together with the silicone wax of this invention may include all the heat-fusible materials known in the art, which are not particularly limited, but specific examples of the heat-fusible materials preferably used in this invention may include, for example, paraffin group waxes such as paraffin wax, microwax, polyethylene wax, etc.; natural waxes such as beeswax, carnauba wax, wood wax, etc.; ester group waxes such as Hoechst wax, etc.; higher fatty acids such as stearic acid, palmitic acid, behenic acid, myristic acid, 1,20-eicosane diacid, etc.; higher alcohols such as stearyl alcohol, palmityl alcohol, etc.; higher amides such as stearoamide, oleoamide, palmityloamide, etc.; esters such as butyl stearate, ethyl palmitate, myristyl stearate, etc.; and so on.

The colorant-containing layer of this invention may also contain resins known in the art.

For example, the colorant-containing layer of this invention may preferably contain at least one resin selected from petroleum resins obtained by copolymerization of the distillates having 5 or more carbon atoms among the petroleum naphtha cracking products, coumarone-indene resins, terpene resins, phenol resins, xylene resins, toluene resins, ester gums, rosins, hydrogenated rosins, modified rosins, aliphatic hydrocarbon resins and alicyclic hydrocarbon resins.

The rosinous polymers are commercially available. For example, ester gums may include Ester EG-H produced by Tokushima Seiyu K. K., S-80, S-100, EK-1001, HP and HD produced by Arakawa Kagaku K. K. As for rosins, there are commercially available natural rosins such as rosins produced in China, and also polymerized Rosin Polypale produced by Arakawa Kagaku K. K. A typical example of hydrogenated rosin is Highpale produced by Arakawa Kagaku K. K. Examples of aliphatic hydrocarbon resins are Kraton 100 series resins such as Kraton B-170, N-180, D-100 and D-200 produced by Nippon Zeon K. K., and Arapole 1070 and 1090 produced by Arakawa Kagaku K. K. Alicyclic hydrocarbon resins may be exemplified by Kraton 1000 series resins such as Kraton 1300, 1500 and 1789 produced by Nippon Zeon K. K. and Alcon P70, P80 and P90 produced by Arakawa Kagaku K. K.

The ester gums preferably used in this invention are hydrogenated rosin esters, glycerine esters of modified rosins, glycerine esters of special rosins, pentaerythritol esters of hydrogenated rosins, ethyleneglycol esters of hydrogenated rosins and the like.

In this invention, one or a combination of two or more selected from these rosinous polymers may be used.

The colorant-containing layer may also contain an ethylene-alkyl acrylate copolymer or an ethylene-alkyl methacrylate copolymer. The alkyl in these polymers may be a straight or branched alkyl having 1 to 18 carbon atoms, the copolymerization ratio of ethylene to an alkyl (meth)acrylate may preferably be within the range of from 95/5 to 20/80, having preferably a softening point of 200° C. or lower (as measured by the ring and ball method), particularly preferably from 50° to 200° C. Examples of such polymers may include ethylene-ethyl acrylate copolymer, ethylene-propyl acrylate copolymer, ethylene-n-butyl acrylate copolymer, ethylene-isobutyl acrylate copolymer, ethylene-octyl acrylate copolymer, ethylene-stearyl acrylate copolymer, ethylene-ethyl methacryalte copolymer, ethylene-propyl methacrylate copolymer, ethylene-n-butyl methacrylate copolymer, ethylene-isobutyl methacrylate copolymer, ethylene-octyl methacrylate copolymer, ethylene-stearyl methacrylate copolymer and the like.

These copolymers may be used either singly or as a combination of two or more copolymers. Also, they can be used as a mixture with other known resins.

Further, the resin to be used in this invention may be either a hydrophilic or hydrophobic polymer having a softening point of about 40° to 200° C. as measured by the ring and ball method. The hydrophilic polymer may be, for example, natural products or derivative thereof, including gelatin, gelatin derivatives, cellulose derivatives, proteins such as casein, polysaccharide such as starch; synthetic water-soluble polymers including water-soluble polyvinyl compounds such as polyvinyl alcohol, polyvinyl pyrrolidone, acrylamide polymer, etc.; and further vinyl type or polyurethane type polymer latices. The hydrophobic polymers may include synthetic polymers as disclosed in U.S. Pat. Nos. 3,142,586; 3,143,386; 3,062,674; 3,220,844, 3,287,289; and 3,411,911. Preferable polymers are polyvinyl butyral, polyvinyl formal, polyethylene, polypropylene, polyamide, ethyl cellulose, cellulose acetate, polystyrene, polyvinyl acetate, pllyvinyl chloride, polyvinylidene chloride, vinyl chloride-vinyl acetate copolymer, vinyl chloride-vinyl acetate-maleic acid terpolymer, acrylic resins such as polymethyl methacrylate, and so on.

The colorant to be contained in the colorant-containing layer of this invention may be selected suitably from the dyestuffs known in the art. For example, it can be chosen from direct dyes, acid dyes, basic dyes, disperse dyes and oil-soluble dyes. The dyestuff to be used in the colorant-containing layer of this invention may be also a pigment in addition to those mentioned above, because it may be a dyestuff transferrable together with the heat-fusible material containing the silicone wax of this invention.

Examples of dyestuffs are set forth below. That is, as yellow dyestuffs, there may preferably be employed Kayalon Polyester Light Yellow 5G-S (Nippon Kayaku), Oil Yello S-7 (Hakudo), Aizen Spiron GRH Special (Hodogaya), Sumiplasto Yellow FG (Sumitomo), Aizen Spiron Yellow GRH (Hodogaya), etc. Red dyestuffs may preferably be Diacellitone Fast Red R (Mitsubishi Kasei), Dianix Brilliant Red BS-E (Mitsubishi Kasei), Sumiplast Red FB (Sumitomo), Sumiplast Red HFG (Sumitomo), Kayalon Polyester Pink RCL-E (Nippon Kayaku), Aizen Spiron Red GEH Special (Hodogaya), etc. Blue dyestuffus may preferably be Diacellitone Fast Brilliant Blue R (Mitsubishi Kasei), Dianix Blue FB-E (Mitsubishi Kasei), Kayalon Polyester Blue B-SF Conc. (Nippon Kayaku), Sumiplast Blue 3R (Sumitomo), Sumiplast Blue G (Sumitom), etc. Yellow pigments include Hanza Yellow 3 G, Tartrazine Lake, etc; red pigments Brilliant Carmine FB-Pure (Sanyo Shikiso), Brilliant Carmine 6B (Sanyo Shikiso), Alizarine Lake, etc.; blue pigments Cerlean Blue, Sumikaprint Cyanine Blue GN-0 (Sumitomo), Phthalocyanine Blue, etc.; and black pigments carbon black, gil black, etc. Otherwise, metal particles and metal oxides may also be available. In this invention, carbon black is particularly preferably employed.

The composition in the colorant-containing. layer of this invention is not particularly limited, but preferably comprises 50 to 90 parts (by weight, hereinafter the same) of a heat-fusible material containing silicone wax of this invention, 5 to 20 parts of a colorant and 0 to 20 parts of resins based on 100 parts of the colorant-containing layer.

In addition to the above components, the colorant-containing layer may also contain various additives. For example, as softening agents, there may preferably be employed vegetable oils such as castor oil, linseed oil, olive oil, etc., animal oils such as whale oil and mineral oils. The colorant-containing layer of this invention may be formed of one layer or two or more layers.

The heat-sensitive transfer recording medium of this invention has at least the colorant-containing layer of this invention and may also have other layer such as subbing layer. For example, subbing layers may be exemplified by layers of silicone resin, melamine resin, polyvinyl acetal resin, polyethylene, polyvinyl chloride, polyvinylidene chloride, fluorine resin, etc. and coating of the subbing layer may be applied prior to coating of the colorant-containing layer.

Also, the heat-sensitive transfer recording medium of this invention may also have a non-transferable color holding layer containing a heat-migratable colorant provided on the support, and the colorant-containing layer of this invention provided thereon.

The support as the substrate to be used in the heat-sensitive transfer recording medium of this invention is desired to have heat-resistant strength and high dimensional stability and surface smoothness. As the heat-resistant strength, it is required to have strength and dimensional stability capable of holding toughness without being softened or plastified by the heating temperature of the heating source such as thermal head, and the surface smoothness desirably sufficiently such that the layer containing the heat-fusible substance on the support may exhibit good degree of transfer.

The degree of smoothness should preferably be 100 sec or more as measured by the smoothness test (JIS P 8119) using a Bekk tester and an image with better transfer degree and reproducibility can be obtained with a smoothness degree of 300 sec or more. The materials for the support may include, for example, papers such as plain paper, condenser paper, laminated paper, coated paper, etc.; resin films such as of polyethylene, polyethyleneterephthalate, polystyrene, polypropylene, polyimide, etc.; paper-resin film composites; metal sheets such as aluminum foil; and others. The thickness of the support may be generally about 60 um or less in order to obtain good thermal conductivity, particularly preferably 2 to 20 um. The constitution of the back side of the support for the heat-sensitive transfer recording medium of this invention may be designed as desired.

In the heat-sensitive transfer recording medium of this invention, the technique suitable for coating a support such as of a polymeric film with the colorant-containing layer is known in the art, and these techniques can be used in this invention. For example, the colorant-containing layer is a layer formed by hot melt coating of its composition or by solvent coating of a coating liquid prepared by dissolving or dispersing the composition in a suitable solvent. As the method for coating the colorant-containing layer of this invention, there may be employed any known technique such as the reverse roll coater method, the extrusion coater method, the gravure coater method, the wire bar coating method, etc. The colorant-containing layer may be made to have a thickness of 15 um or less, preferably 2 to 8 um.

According to this invention, in a heat-sensitive tranfer recording medium having a heat-sensitive transferable colorant-containing layer on a support, since the colorant-containing layer has a silicone wax which is solid or semi-solid at room temperature, the objects as mentioned above can be accomplished, and also high speed recording (printing) is possible because of its high sensitivity, when applied for a heat-sensitive transfer recording medium to be used for a large number of times.

This invention is further described by referring to the following Examples, by which this invention is not limited. In these Examples, "part(s)" means "part(s) by weight".

EXAMPLE 1

| | |
|---|---|
| Dimethylpolysiloxane (m.p. 48° C.) | 12 parts |
| Microcrystalline wax (m.p. 69° C.) | 4 parts |
| Carbon black | 3 parts |
| Toluene | 50 parts |

The above composition was dispersed in a hot ball mill for 24 hours to prepare a coating liquid (1) for colorant-containing layer.

The coating liquid (1) was applied with a wire bar on a polyethyleneterephthalate support with a thickness of 5.4 um to provide a colorant-containing layer having a thickness after drying of 3.5 um to obtain a heat-sensitive transfer recording medium sample (1).

The heat-sensitive transfer recording medium sample (1) was used for printing letters by means of a thermal printer (trial machine mounted with a thin film type line thermal head of a heat-generating element density of 8 dot/mm) by varying the applied energy from 0 to 0.6 mJ/dot at intervals of 0.03 mJ/dot, and the optical reflective density of the dyestuff tranfer image was measured by means of a reflective densitometer (produced by Konishiroku Photo Industry Co.). The applied energy necessary for obtaining 0.9-fold of the maximum optical reflective density was defined as the transfer sensitivity. As the result, the applied energy necessary for obtaining the dyestuff transfer image of the density 1.4 was found to be 0.38 mJ/dot. No generation of ground staining (fog) was observed.

EXAMPLE 2

| | |
|---|---|
| Polyether-modified silicone wax (produced by Shinetsu Kagaku Kogyo K.K., KKF 907) | 15 parts |
| Microcrystalline wax (m.p. 69° C.) | 3 parts |
| Carbon black | 3 parts |
| Toluene | 50 parts |

The above composition was dispersed in a hot ball mill for 24 hours to prepare a coating liquid (2) for colorant-containing layer.

The coating liquid (2) was applied with a wire bar on a polyethyleneterephthalate support with a thickness of 5.4 um to provide a colorant-containing layer having a thickness after drying of 3.5 um to obtain a heat-sensitive transfer recording medium sample (2).

The heat-sensitive transfer recording medium sample (2) was used for printing letters by means of a thermal printer (trial machine mounted with a thin film type line thermal head of a heat-generating element density of 8 dot/mm) by varying the applied energy from 0 to 0.6 mJ/dot at intervals of 0.03 mJ/dot, and the optical reflective density of the dyestuff tranfer image was measured by means of a reflective densitometer (produced by Konishiroku Photo Industry Co.). The applied energy necessary for obtaining 0.9-fold of the maximum optical reflective density was defined as the transfer sensitivity. As the result, the applied energy necessary for obtaining the dyestuff transfer image of the density 1.4 was found to be 0.38 mJ/dot (determined by plotting on a graph; hereinafter the same). No generation of ground staining (fog) was observed.

EXAMPLE 3

A heat-sensitive transfer recording medium sample (3) was obtained according to entirely the same procedure as in Example 2 except for using an alcohol-modified silicone wax (X-22-801b produced by Shinetsu Kagaku Kogyo K. K.) in place of the polyether-modified silicone wax and further 3 parts of a paraffin wax (m.p. 62° C.) in place of 3 parts of the microcrystalline wax in the colorant-containing layer composition.

For this sample (3), printing was tried to be conducted similarly as in the case of the sample (2). As the result, the dyestuff transfer image of 1.4 was obtained at an applied energy of 0.36 mJ/dot. Also, no ground staining (fog) was found to be generated.

COMPARATIVE EXAMPLE 1

According to entirely the same procedure as in Example 1 except for employing a paraffin wax (m.p. 48° C.) in place of dimethylpolysiloxane in the colorant-containing layer composition, a heat-sensitive transfer recording medium (4) was obtained.

For this sample (4), printing was tried to be conducted according to the same method as in the case of sample (1), and only a dyestuff transfer image of the density of 0.3 could be obtained at the applied energy of 0.39 mJ/dot. Further, when the applied energy was increased to obtain a dyestuff transfer image of the density of 1.4, resolution was observed to be lowered. At the same time, ground staining (fog) was observed to be generated in this case.

We claim:

1. A heat transfer recording method comprising a step of transferring a colorant onto a recording sheet from a heat-sensitive transfer recording medium by means of heat, said heat-sensitive transfer recording medium comprising a support and a colorant-containing layer provided thereon which contains the colorant and a heat-fusible material comprising a silicone wax which is solid or semi-solid at ambient temperature.

2. The method of claim 1, wherein said silicone wax is represented by the formula:

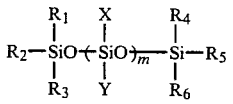

wherein X, Y, $R_1$ to $R_6$ independently represent a hydrogen atom, an alkyl group, an aryl group, an aralkyl group, an alkoxy group or a group represented by the following formula (1) or (2), Formula (1)

$$-(CH_2O)_a(C_2H_4O)_b(C_3H_6)_cR_7$$

wherein $R_7$ represents an alkyl group and each of a, b and c represents an integer not less than 0;

Formula (2)

$$-O-CO-C_nH_{2n}R_8$$

wherein $R_8$ represents a hydrogen atom, an alkyl group, an aryl group or an aralkyl group, n is a positive integer, m is a positive integer, and when m is more than 1, each of X's and Y's may be either the same or different.

3. The method of claim 2, wherein at least 10% in number of said X and Y are neither a hydrogen atom nor a methyl group.

4. The method of claim 2, wherein said silicone wax is represented by the following formula (II):

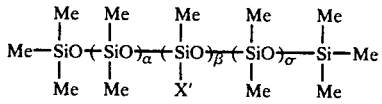

(II)

wherein Me represents a methyl group, X' is selected from the group consisting of $-C_nH_{2n}R_8$($R_8$ represents a hydrogen atom or a substituent such as a straight or branched alkyl group or aralkyl group), $-O-C_nH_{2n}R_8$($R_8$ is the same as defined above), $-O-CO-C_nH_{2n}R_8$($R_8$ is the same as defined above), $-C_nH_{2n}Y$ (Y represents a group —OH, or a group —SH,) $-C_nH_{2n}COOR_9$ ($R_9$ represents an alkyl group or other organic group having 1 to 40 carbon atoms) or $(CH_2O)_a(C_2H_4O)_b(C_3H_6O)_cR_7$($R_7$ represents an alkyl group, and a, b and c are integers of 0 or more), each n being positive integer; and $\alpha$, $\beta$ and $\sigma$ are each integer of 0 or more, with proviso that all of $\alpha$, $\beta$ and $\sigma$ cannot be zero at the same time.

5. The method of claim 1 wherein said silicone wax has two-dimensional structure.

6. The method of claim 1, wherein said silicone wax has three-dimensional structure.

7. The method of claim 1, wherein said silicone wax has a melting point higher than 30° C.

8. The method of claim 7, wherein said silicon wax has a melting point of 40° C. or higher.

9. The method of claim 1, wherein said colorant-containing layer contains said silicone wax in the range of from 10% to 100% by weight of the whole of said heat-fusible material.

10. The method of claim 9, wherein said colorant-containing layer contains said silicone wax in the range of 50% or more by weight of the whole of said heat-fusible material.

11. The method of claim 1, wherein said colorant is selected from the group consisting of direct dyes, acid dyes, basic dyes, disperse dyes, oil-soluble dyes and pigments.

12. The method of claim 1, wherein said colorant-containing layer contains at least one resin selected from the group consisting of petroleum resins obtained by copolymerization of distillates having 5 or more carbon atoms among the petroleum naphtha cracking products, coumarone-indene resins, terpene resins, phenol resins, xylene resins, toluene resins, ester gums, rosings, aliphatic hydrocarbon resins and alicyclic hydrocarbon resins.

* * * * *